US007241164B2

(12) United States Patent
Holliday

(10) Patent No.: US 7,241,164 B2
(45) Date of Patent: Jul. 10, 2007

(54) TERMINATION ASSEMBLY FOR MINI-COAXIAL CABLE HAVING COLOR-CODED INSULATOR

(75) Inventor: Randall A. Holliday, Broomfield, CO (US)

(73) Assignee: International Communication Manufacturing Corporation, Denver, CO (US)

( * ) Notice: Subject to any disclaimer, the term of this patent is extended or adjusted under 35 U.S.C. 154(b) by 0 days.

(21) Appl. No.: 10/899,787

(22) Filed: Jul. 26, 2004

(65) Prior Publication Data

US 2005/0026497 A1 Feb. 3, 2005

Related U.S. Application Data

(63) Continuation-in-part of application No. 10/654,808, filed on Sep. 3, 2003, now Pat. No. 6,935,892, and a continuation-in-part of application No. 10/313,787, filed on Dec. 6, 2002, now Pat. No. 6,805,583, and a continuation-in-part of application No. 10/752,287, filed on Jan. 6, 2004, now Pat. No. 7,044,771.

(51) Int. Cl.
*H01R 3/00* (2006.01)

(52) U.S. Cl. ..... 439/491; 439/488; 439/584; 439/585

(58) Field of Classification Search ..... 439/488, 439/491, 578, 584, 585
See application file for complete search history.

(56) References Cited

U.S. PATENT DOCUMENTS 3,601,524 A 8/1971 Kauffman
4,202,351 A * 5/1980 Biche ..... 600/508
5,187,887 A * 2/1993 Mori et al. ..... 40/316
5,232,377 A 8/1993 Leibfried et al.
5,392,508 A 2/1995 Holiday et al.
5,470,257 A * 11/1995 Szegda ..... 439/578
5,529,513 A * 6/1996 Lee ..... 439/491
5,596,800 A 1/1997 Holliday et al.
5,651,698 A 7/1997 Locati et al.
5,769,662 A * 6/1998 Stabile et al. ..... 439/578
5,938,465 A 8/1999 Fox, Sr.
6,042,422 A * 3/2000 Youtsey ..... 439/585
6,159,046 A 12/2000 Wong
6,179,656 B1 1/2001 Wong
D440,539 S 4/2001 Montena
6,352,448 B1 3/2002 Holliday et al.
6,752,650 B1 * 6/2004 Lin ..... 439/491
7,044,771 B2 * 5/2006 Holliday ..... 439/491

* cited by examiner

*Primary Examiner*—Xuong Chung-Trans
(74) *Attorney, Agent, or Firm*—The Reilly Intellectual Property Law Firm, P.C.; John E. Reilly; Ellen Reilly

(57) ABSTRACT

A termination assembly for a mini-coaxial cable wherein the connector body is conformable for use with different sized cables, the connector body can be assembled in the field with selected crimping members and centering guides of matching colors to signify the cable size to be inserted into the connector body, and each different sized cable may include a portion which is color-coded to correspond to the colors of the crimping member and guide assembled into the connector body for that size of cable.

14 Claims, 6 Drawing Sheets

TERMINATION ASSEMBLY FOR MINI-COAXIAL CABLE HAVING COLOR-CODED INSULATOR

CROSS-REFERENCE TO RELATED APPLICATIONS

This application is a continuation-in-part of patent application Ser. No. 10/654,808, filed 3 Sep. 2003 for ADAPTER FOR MINI-COAXIAL CABLE by Randall A. Holliday now U.S. Pat. No. 6,935,892, incorporated by reference herein, a continuation-in-part of patent application Ser. No. 10/313,787, filed 6 Dec., 2002 for MINI-COAXIAL CABLE CONNECTOR AND METHOD OF INSTALLATION by Randall A. Holliday and Sheng Chia Wong, now U.S. Pat. No. 6,805,583, incorporated by reference herein; and a continuation-in-part of patent application Ser. No. 10/752,287, filed 6 Jan., 2004, for CABLE CONNECTOR HAVING INTERCHANGEABLE COLOR BANDS by Randall A. Holliday, now U.S. Pat. No. 7,044,771, and incorporated by reference herein.

BACKGROUND AND FIELD OF INVENTION

This invention relates to coaxial cable connectors and more particularly relates to a novel and improved termination assembly or adapter for coaxial cable end connectors used in splicing a cable to another cable or connecting to a post or terminal.

The problems associated with the connection of mini-coax cables as well as larger size cables to a post or terminal in the field are discussed at some length in hereinabove referred to copending application for patent for MINI-COAXIAL CABLE CONNECTOR and in U.S. Pat. No. 6,352,448 for CABLE TV END CONNECTOR STARTER GUIDE. This invention is directed to further improvements in termination assemblies to be employed for mini-coaxial cables in which the termination assembly is characterized in particular by being comprised of a minimum number of parts which can be quickly assembled at the manufacturing site as well as in the field and is particularly useful for connection of a mini-coaxial cable to an RCA connector. Further, it is desirable to provide a connector body which is conformable for use with different sized cables, and the connector body can be assembled in the field with selected crimping members and centering guides of matching colors to signify the cable size to be inserted into the connector body, and each different sized cable may include a portion which is color-coded to correspond to the colors of the crimping member and guide assembled into the connector body for that size of cable.

SUMMARY OF THE INVENTION

It is therefore an object of the present invention to provide for a novel and improved adapter for coaxial cables.

It is another object of the present invention to provide for a novel and improved adapter for small diameter coaxial cables which can be installed in the field in a minimum number of steps with minimal tooling required.

It is a further object of the present invention to provide for a novel and improved adapter for coaxial cable installations which assures accurate alignment between the cable and connector preliminary to crimping of the connector onto the cable and prevents shorting between the cable layers with one another as well as with conductive portions of the connector.

It is a still further object of the present invention to provide for a novel and improved adapter for preparing the end of a coaxial cable for installation into an end connector having a preassembled crimping ring.

It is a still further object of the present invention to provide for a termination assembly utilizing a single size of connector body for different cable sizes, the connector body being assembled in the field with different sized parts which are color-coded to match up with the cable size to be installed thereby minimizing the number of parts carried by the installer.

In accordance with the present invention, an adapter is provided for connecting the end of a coaxial cable to a hollow connector body wherein the cable is of the type having inner and outer concentric electrical conductors, an annular dielectric separating the conductors and an outer jacket of electrically non-conductive material, the inner and outer conductors being exposed and the inner conductor projecting beyond the dielectric at one end of the cable; and the adapter comprises at least one sleeve having a conductive portion surrounding the outer conductor, an electrically non-conductive portion surrounding the dielectric layer and with an opening at its leading end for mounting of an extension tip into electrical contact with the inner conductor. In one form, the one sleeve may be provided with an enlarged opening with respect to the dielectric layer to permit insertion of a second sleeve therebetween which will assist in centering and alignment of the inner conductor. The one sleeve is dimensioned such that a crimping ring, for example, for an RCA connector will cause the sleeve to be compressed into sealed engagement with the dielectric layer and will insulate the outer braided layer from shorting, and the trailing end of the one sleeve is slotted to form prong-like segments having internal and external teeth so that the trailing end of the sleeve can be compressed into engagement with the cable without crushing the dielectric layer.

The connector body as described lends itself well for use as a universal connector for several different sized cables in which selected parts of each connector body are color-coded to match a color-coded portion on each different cable size to facilitate assembly in the field and assure correct matching with each cable size to be installed.

It is therefore to be understood that even though numerous characteristics and advantages of the present invention have been set forth in the foregoing description, together with details of the structure and function of the invention, the disclosure is illustrative only, and changes may be made within the principles of the invention to the full extent indicated by the broad general meaning of the terms in which the appended claims are expressed and reasonable equivalents thereof.

The above and other objects, advantages and features of the present invention will become more readily appreciated and understood from a consideration of the following detailed description of preferred and modified forms of the present invention when taken together with the accompanying drawings in which:

DETAILED DESCRIPTION OF FIRST EMBODIMENT

Figure 1:
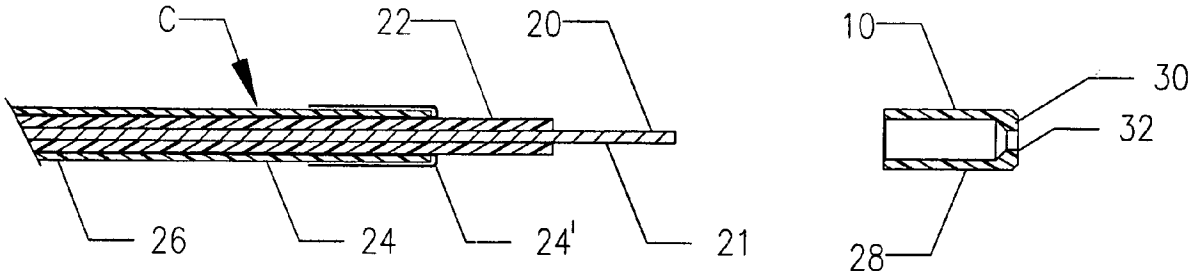
FIG. 1 is an exploded view in section of a mini-coax cable and one form of intermediate sleeve in accordance with the present invention.
Figure 2:
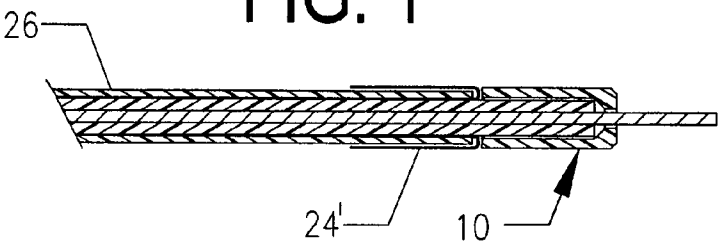
FIG. 2 is an exploded view in section of the cable and sleeve shown in FIG. 1 in assembled form.

Referring in more detail to the drawings, there is illustrated in FIGS. 1 to 8 a first embodiment of the present invention which is broadly comprised of a standard coaxial cable C, sleeves 10 and 12, an RCA type of cable connector 14, and an extension tip 16.

As a setting for the present invention, the cable C is comprised of an inner conductor pin or wire 20 which is surrounded by a dielectric insulator 22 of electrically non-conductive material, such as, a rubber or rubber-like material, a braided conductor layer 24, and an outer jacket 26 of an electrically non-conductive material, such as, a rubber or rubber-like material. The end of the cable C is further prepared for assembly by removing a limited length of the jacket 26 and braided conductor 24 as well as the insulated layer 22 in order to expose an end of the pin 20 along with foil layer 21 surrounding the pin 20. The braided conductor layer 24 is peeled away from the insulator 22 and doubled over as at 24' to cover the leading end of the jacket 26.

As shown in FIG. 1, the sleeve 10 has a thin-walled, hollow cylindrical body 28 of uniform thickness throughout its length and terminating in an annular end wall 28 provided with a central bore 32. The sleeve 10 is dimensioned such that the wall 28 will fit snugly over the insulator layer 22 until its trailing end abuts the end of the doubled over layer 24', and the pin 20 will extend through the bore 32 with the end wall 30 abutting the end of the layer 22. For this purpose, the layer 22 is exposed for a length corresponding to the length of the wall portion 28 of the sleeve 10 when assembled in the relationship shown in FIG. 2.

Figure 3:
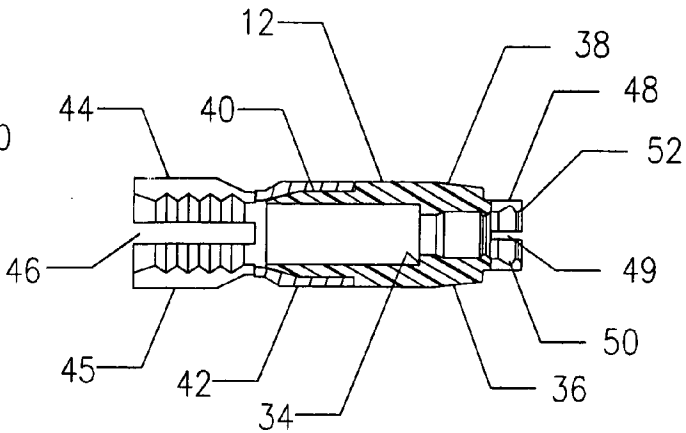
FIG. 3 is an exploded view in section of the assembly shown in FIG. 2 and an outer sleeve adapted to receive the assembly of FIG. 2.
Figure 3:
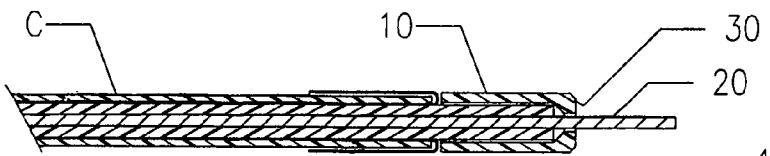
Figure 4:
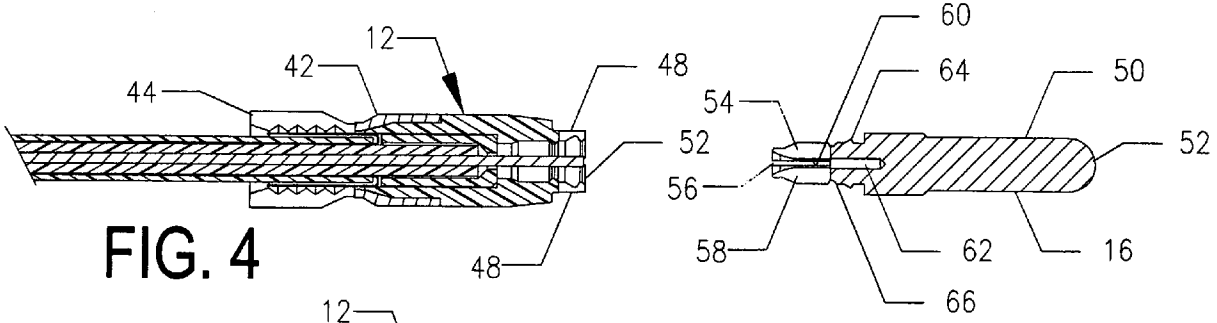
FIG. 4 is another exploded view in section of the assembly shown in FIG. 3 and an extension tip.

Referring to FIG. 3, the assembled cable C and sleeve 10 are adapted to be inserted into a sleeve 12 until the end wall 30 abuts an internal shoulder 34 and the pin 20 projects through the remaining length of the sleeve 12 into the relationship shown in FIG. 4. The sleeve 12 is of two-piece construction including an elongated tubular portion 36 of electrically non-conductive material with an outer generally convex wall surface 38 which is undercut at 40 to receive a relatively thin-walled sleeve 42 of electrically conductive material. The sleeve 42 diverges into relatively thick arcuate end portions 44 which are separated by longitudinally extending slots 46. The opposite end 36 of the tubular portion 36 has an inner wall surface 36 which diverges into a thin-walled annular end retainer 48. The retainer 48 is slotted at circumferentially spaced intervals, such as, at 49 and is provided with an internal circumferential groove 50 directly within the retainer 48.

As best seen from FIG. 3, the assembled cable C and sleeve 10 are inserted into the outer sleeve 12 until the end wall 30 abuts the internal shoulder 34 and the slotted segments 44 are positioned over the doubled over layer 24' and jacket 26. In this relation, the pin 20 will project through the relatively thick-walled end of the tubular portion 36 and terminate at the entrance to the end retainer 48.

Figure 5:
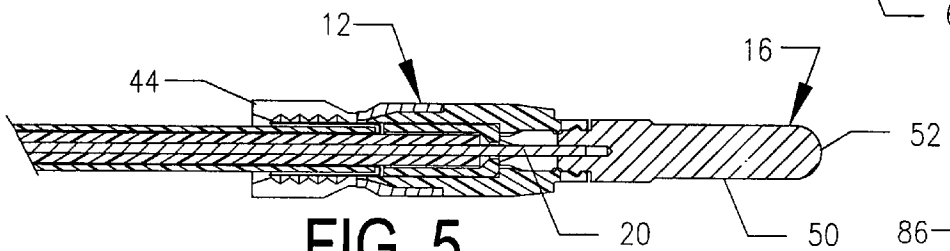
FIG. 5 is a view in section illustrating the extension tip of FIG. 4 inserted into the end of the sleeve.

The extension tip 16 is illustrated in FIG. 4 prior to its connection to the end retainer 48. The extension tip 16 is made up of a solid, elongated cylindrical metal body 50 terminating in a nose 52 at one end and in a slotted end portion 54 at its opposite end. The slotted end 54 includes longitudinal slots 56 dividing the end portion into arcuate segments 58 and together forming a common central opening 60 which is aligned and communicates with a bore 62 in the end of the solid extension portion 50. An external shoulder or ridge 64 extends circumferentially around a reduced end portion 66 of the body 50, and the external ridge 64 is dimensioned to be of a slightly greater diameter than the retainer 48 so as to force the end retainer 48 to expand slightly until the ridge 64 moves into press-fit engagement with the retainer 48. The slotted end 54 is of a diameter to advance forwardly through the inner wall 37 of the tubular portion 36 and permit advancement of the pin 20 through the central opening 60 and 62, as illustrated in FIG. 5.

It is important to dimension the width of the slots 46 to limit the amount of contraction of the segments 44 so that the teeth 45 will compress the jacket 26 enough to prevent pull-out but not enough to crush the dielectric layer 22. This is especially important in cables operating at higher bandwidth frequencies in which any bending or crushing of the dielectric can create an impedance that downgrades the signal and prevents good return loss.

Figure 6:
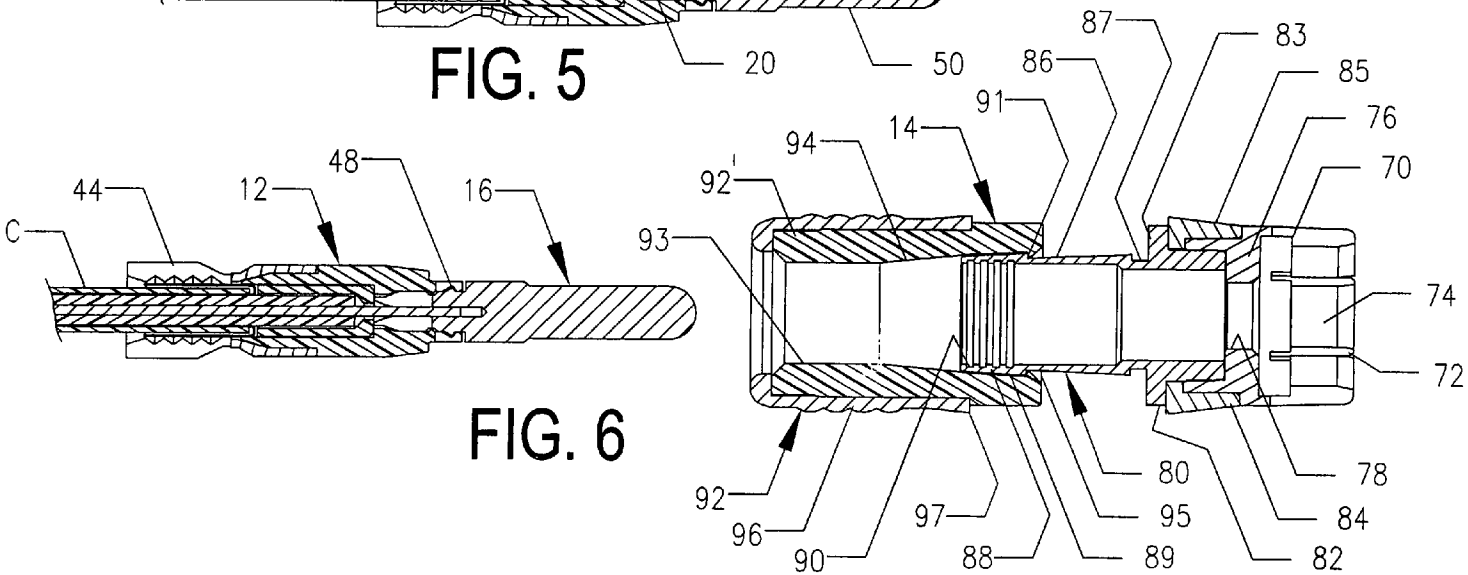
FIG. 6 is an exploded view in section of the assembly shown in FIG. 5 and a coaxial cable connector housing.
Figure 7:
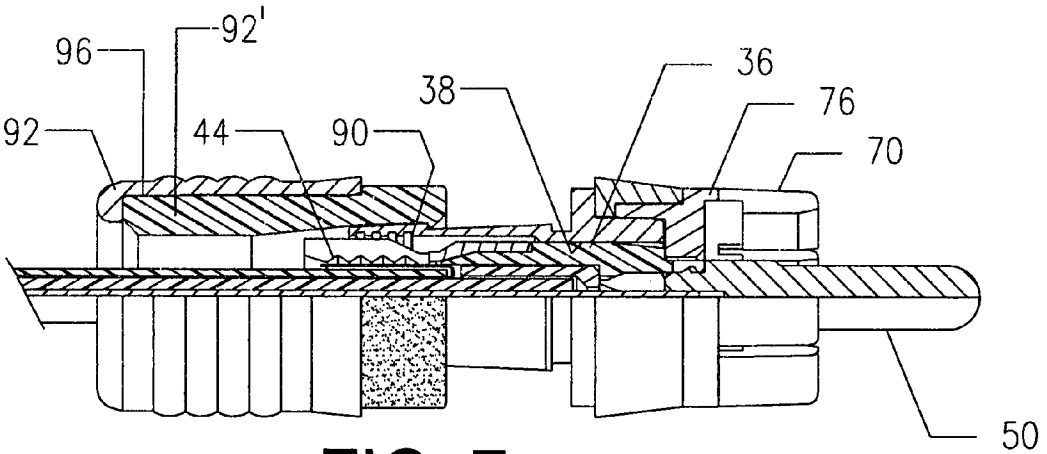
FIG. 7 is a view partially in section of the parts shown in FIG. 6 in assembled form prior to crimping.
Figure 8:
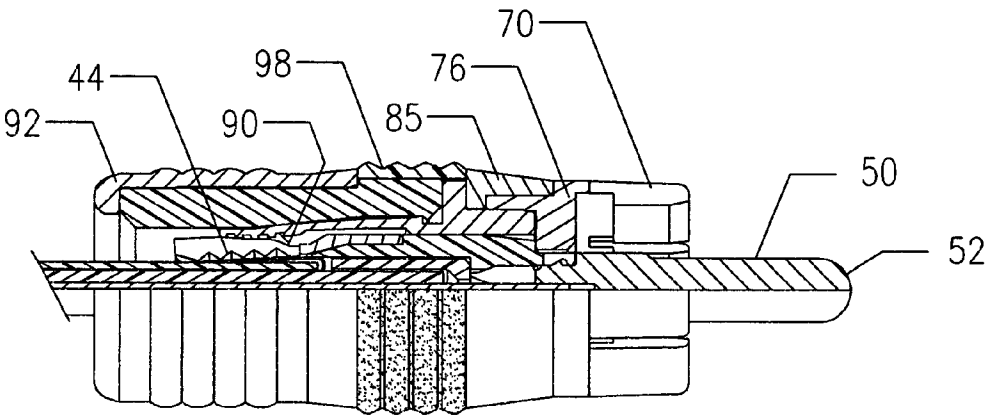
FIG. 8 is a view partially in section illustrating the assembly of FIG. 7 after the crimping operation.

FIGS. 6 to 8 illustrate the manner in which the termination assembly comprising the cable C, sleeve 12 and extension tip 16 are installed in a CATV connector 14 which is of the RCA type for mini-coaxial cables. The connector 14 is made up of a ferrule 70 which is slotted as at 72 into springlike segments 74 to facilitate attachment to a post or terminal. An annular base portion 76 of the ferrule 70 and elongated tubular member 80 form a central bore or passage 77 for insertion of the tip 16 beyond the end of the ferrule, as shown in FIGS. 7 and 8, and the elongated tubular member 80 has one end mounted in the base 76. A keeper 84 of annular configuration is mounted between the base 76 and an external shoulder 82 on the end portion 82, the keeper provided with an external shoulder 85 which projects radially outwardly of the shoulder 83 and tapers forwardly into flush relation to the external surface of the ferrule 70. Again, the elongated tubular member 80 extends rearwardly from the shoulder portion 82 to define a first sleeve portion 86 which tapers rearwardly away from a circumferential groove or notch 87 and terminates in a thickened annular end 88 which has a rearwardly tapered outer wall surface 89 and endless ribs or sealing rings 90 on its inner wall surface.

The thickened end 88 of the sleeve 80 also defines an external shoulder 91 to facilitate mounting of a crimping ring 92 in a manner to be described.

The crimping ring 92 is of a type that can be preassembled on the connector 14 and axially advanced over the sleeve 80 to force it into crimping engagement with the slotted end 44 of the sleeve 42. To this end, the crimping ring 92 is made up of an annular body 92' composed of a low-friction material having limited compressibility, such as, DELRIN® or other hardened plastic material. The body has a straight cylindrical portion 93 and a forwardly tapered portion 94 which terminates in a leading end having an internal shoulder or rib 95. The forwardly tapered portion 94 is complementary to the external tapered wall surface 89 on the end portion 88 so that the crimping ring 92 can be axially advanced over the end of the sleeve 80 until the internal shoulder 95 advances past the shoulder 91, as shown in FIG. 6, to preassemble the ring 92 onto the connector 14.

An exterior surface of the body 92' is recessed or undercut to receive a reinforcing band 96 which is preferably composed of brass and which fits snugly over the body 92'. The leading end 97 of the band 96 projects outwardly beyond the external surface of the body to define an external shoulder of a diameter corresponding to that of the trailing edge of the tapered surface portion 85.

Figure 7A:
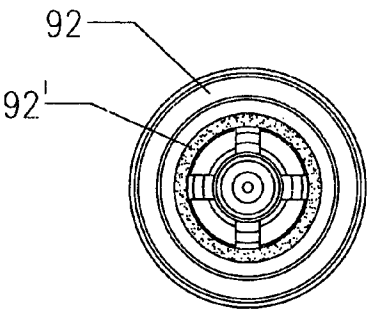
FIG. 7A is an end view of FIG. 7.
Figure 8A:
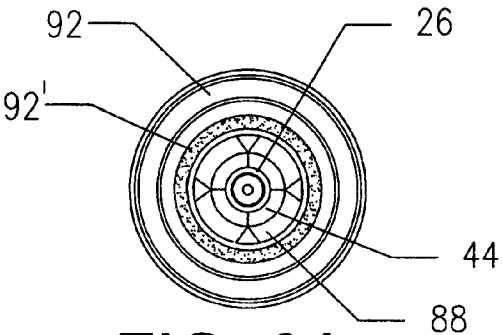
FIG. 8A is an end view of FIG. 8.
Figure 9:
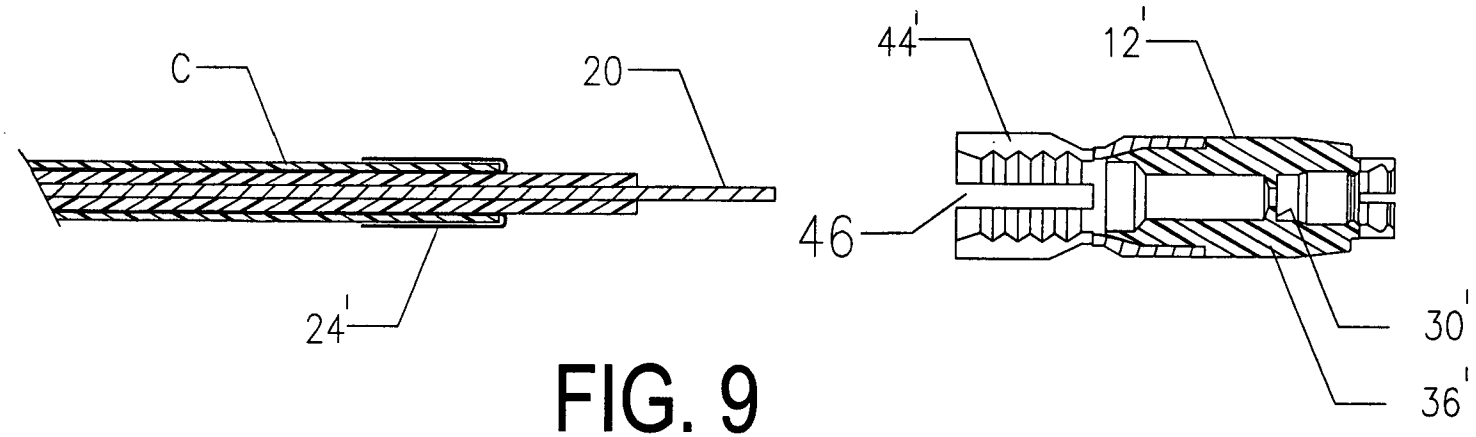
FIG. 9 is an exploded view in section of another form of invention illustrating a mini-coax cable and a sleeve prior to assembly.
Figure 10:
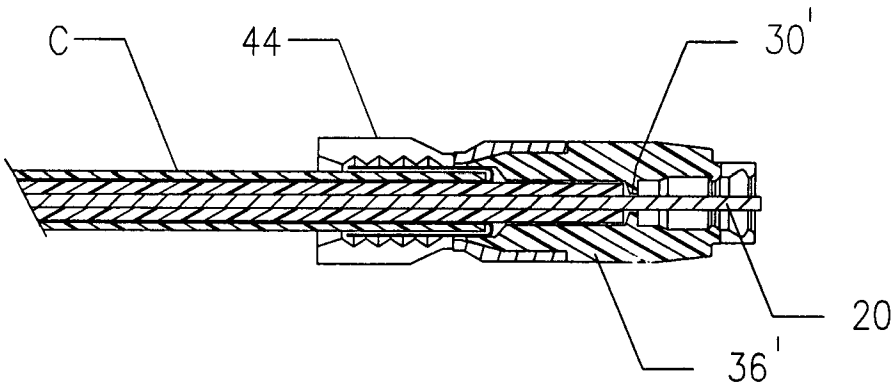
FIG. 10 is another view in section of the cable and sleeve shown in FIG. 9 in assembled form.
Figure 11:
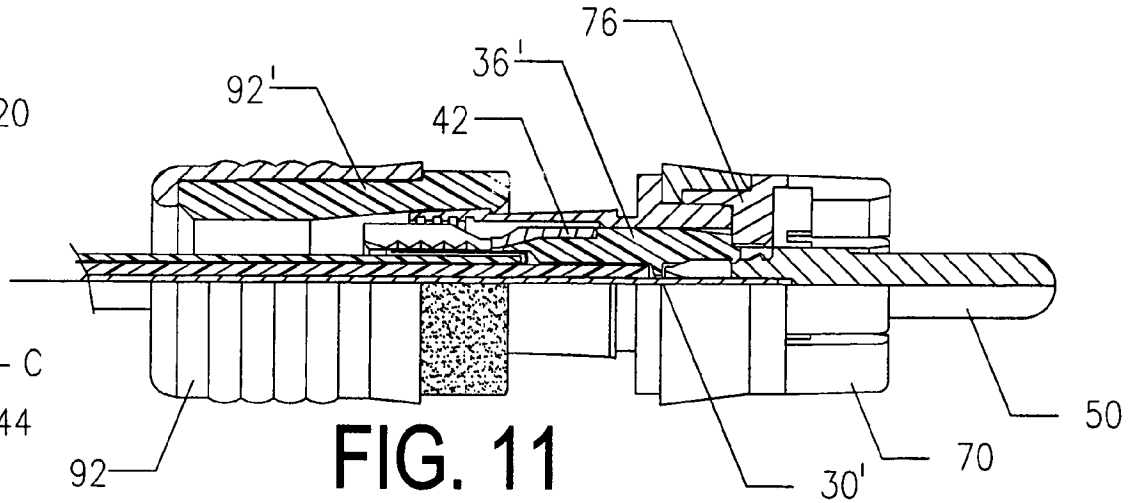
FIG. 11 is a view partially in section of the assembly shown in FIG. 10 inserted into a cable TV connector.

Referring to FIGS. 7 and 7A, the termination assembly is inserted into the connector until the leading edge of the tubular portion 36 abuts the base 76 of the ferrule, the external surface 38 of the tubular portion contacting the inner wall surface of the end portion 82 of the sleeve 80 and the segments 44 being aligned with the sealing rings 90.

A standard crimping tool is employed to axially advance the crimping ring 92 over the sleeve 80 until the leading end or rib 95 moves into snap-fit engagement with the groove 87 and abuts the shoulder 83. The tapered surface 94 will cause the end portion 88 to radially contract and force the sealing ribs 90 into positive engagement with serrations or teeth 45 on the segments 44 and in turn cause the segments 44 to be crimped into positive engagement with the jacket 26 as well as the braided portion 24'. One such crimping tool is disclosed in copending U.S. patent application Ser. No. 09/960,566 for UNIVERSAL CRIMPING TOOL, filed Sep. 20, 2001 and is incorporated by reference herein. The cooperation between the ribs 90 when forced into the teeth 45 and in turn forcing the teeth 45 into engagement with the braided layer 24' as well as the jacket 26 increases the pull-out strength of the termination assembly both with respect to the end of the cable C and the connector 14.

DETAILED DESCRIPTION OF SECOND EMBODIMENT

Mini-coaxial cables are particularly useful in cellular telephones, security cameras and other applications where there are decided space limitations or where short runs of cable are used. It will be evident that the size and proportion of the sleeves 10 and 12 may be varied according to specific wire or cable diameters and be proportioned according to the space allowances between the cable C and the connector 14. For example, as illustrated in FIGS. 9 to 12, a modified form of invention effectively eliminates the sleeve 10 and increases the thickness of the tubular portion 36' compared to that of the tubular portion 36 shown in FIGS. 1 to 8. In addition, an annular guide 30' extends across the tubular portion 36' to cooperate in limiting the forward extension of the cable C into the sleeve and to guide the pin 20.

The width of the slots 46 and 46' referred to in the First and Second Embodiments may be varied in accordance with the amount of contraction required of the segments 44 or 44', respectively, to firmly engage the jacket 26 without crushing the dielectric layer 22.

It will be evident that the crimping tool referred to in the first embodiment and which is described in more detail in my hereinbefore referred to application for UNIVERSAL CRIMPING TOOL is equally effective in crimping the connector 14, sleeve 12 and cable C together. At the same time, the complementary tapered surfaces between the crimping ring 92' and sleeve 80 permit utilization of one size connector 14 in crimping different sized cables C. The only modification required is to the inner diameter of sleeve 12' and adjusting the width of the slots 46 and 46' to properly engage the jacket 26 of the cable without crushing the layer 22 as previously discussed. The termination assembly also can be utilized in cooperation with the UNIVERSAL MULTI-STAGE COMPRESSION CONNECTOR application hereinbefore referred to.

Figure 12:
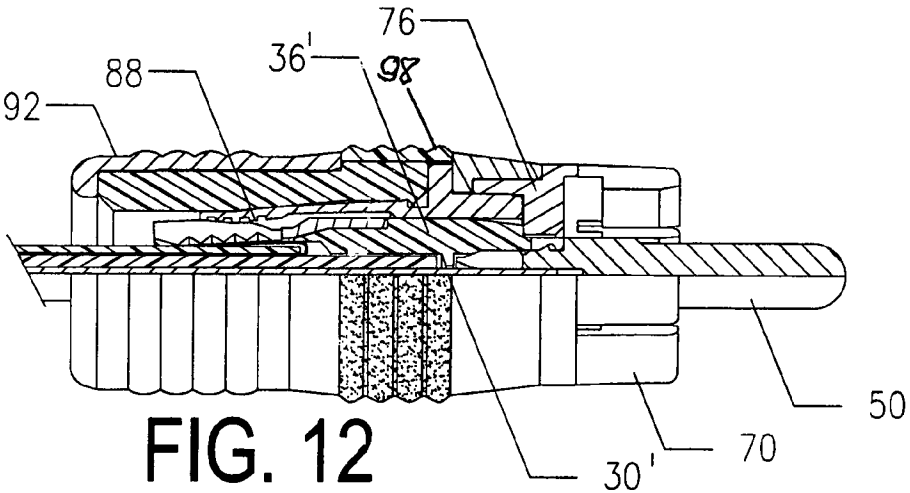
FIG. 12 is a view partially in section illustrating the assembly of FIG. 11 after the connector has been crimped onto the cable.
Figure 11A:
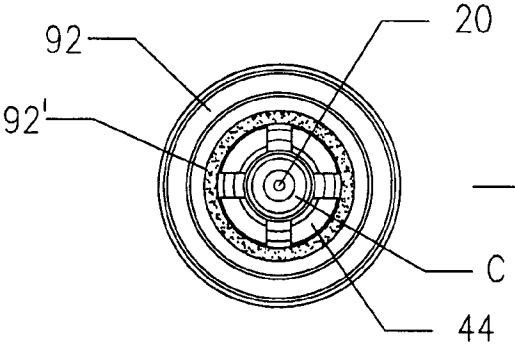
FIG. 11A is an end view of FIG. 11.
Figure 12A:
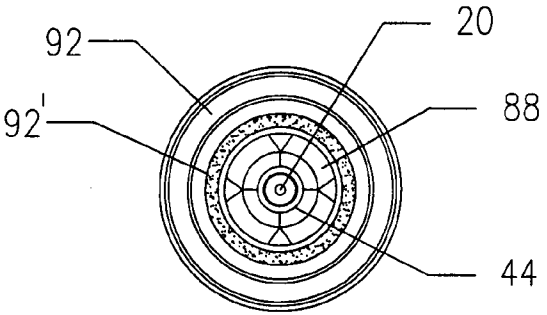
FIG. 12A is an end view of FIG. 12.

A resilient color band 98 may be inserted into the groove formed between the leading end 97 of the band end 96 and the trailing end of the tapered surface portion 85 when the compression connector has been crimped together into the closed position as illustrated in FIG. 8 and FIG. 12. The band 98 is manually stretchable over the end of the outer connector body 14 and, when released, will contract into the groove as described. The band 98 may be of one of several different colors to signify the intended application of the connector to a particular use. In addition, the crimping ring 92 may be of a selected color which represents the size of cable C for which the connector body 14 is designed and which is visible from the end of the connector body as shown in FIG. 7A as well as the exposed end of the crimping ring 92' as shown in FIG. 7. Similarly, the sleeve 12' may be dyed a selected color either at some point along the tubular section 36' or the extension tip body 50 to designate the size of cable C for which it is designed.

DETAILED DESCRIPTION OF THIRD EMBODIMENT

Figure 14:
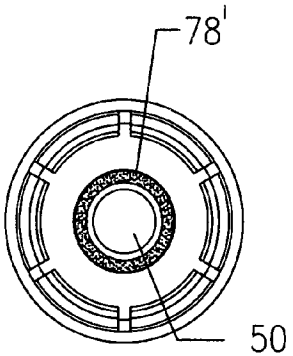
FIG. 14 is an end view of FIG. 13.
Figure 13:
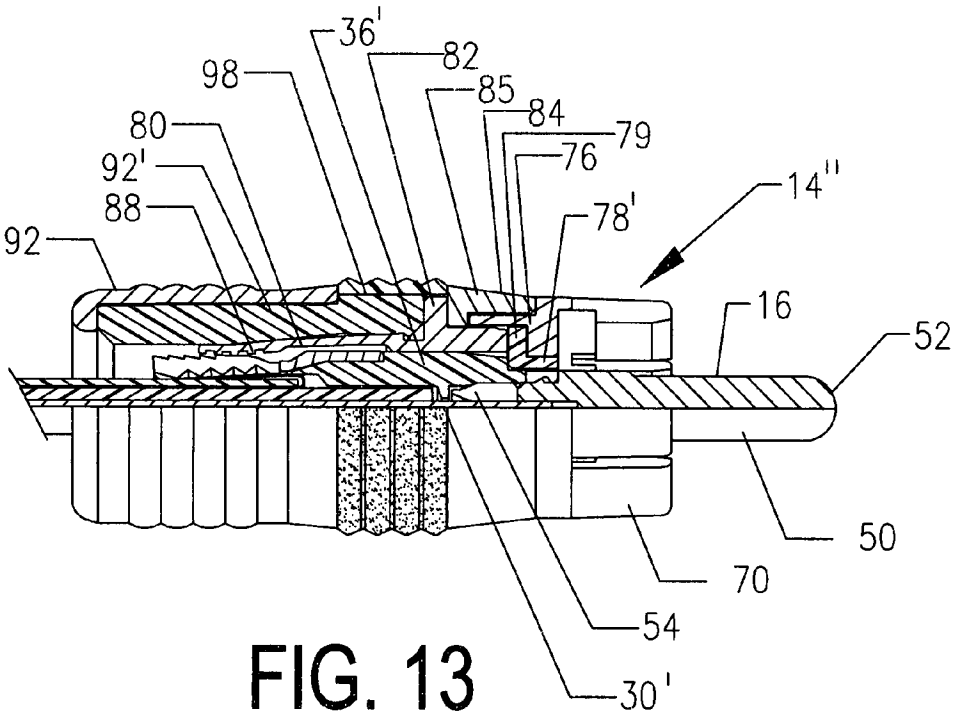
FIG. 13 is a view partially in section of a color-coded termination assembly after the cable has been crimped into position.

FIGS. 13 and 14 illustrate a further improvement to the embodiment of FIGS. 9 to 12 and in which like parts are correspondingly enumerated. An annular guide or liner 78' is composed of a plastic or other non-conductive material and is color-coded to designate the size of the connector body 14. The guide 78' has a radially outwardly projecting flange 79 which is interpositioned between the base portion 76 and one end shoulder portion 82 of an elongated tubular member 80. The keeper 84 is mounted between the base 76 on the end shoulder portion 82, and an external shoulder 85 on the keeper projects radially outwardly of the shoulder 82 and tapers forwardly into flush relation to the external surface of the ferrule 70.

It is possible to utilize one connector body 14, with the exception of the crimping ring 92' and the guide 78', for an entire size range of connectors. The installer is supplied with a bag or carton of the different sized crimping rings 92' for each different sized cable. The cable size is color-coded, for example, by color-coding the extension tip body 50 for each different size cable. Accordingly, the installer can match up the color of a crimping ring 92' and a guide 78' with the color of the body 50 which has already been installed on the cable C. Typically, the guide 78' is assembled within the connector body prior to shipment to the field whereas the correspondingly colored crimping rings 92' are assembled onto the connector bodies as a preliminary to the insertion of the cables C and their extension tip bodies 50. Both the guide 78' and crimping ring 92' are visible from opposite ends of each connector body. In this way, the installer can color match the connector body with a color-coded portion on the cable, such as, a portion of tubular section 36' or the extension tip body 50 to designate the size of cable C to be joined to the connector.

Typically, in an RCA connector, different sizes of cables are utilized depending upon the size of terminal or socket, and a corresponding number of crimping rings 92' and guides 78', each of a different color for each different size, are provided for field installation in the manner described. Although the guides 78 have been described as being installed at the factory during the assembly process for the product, a quantity of different sizes and colors of guides 78' may be furnished to the end user, and an appropriate size and color of guide 78' may be installed by inserting the flange 79 into the space between the end of shoulder 82 and the base portion 76.

That portion of the termination assembly which is made up of the cable C, sleeve 12 and extension member 50 are inserted through the central bore or passage 77 into the connector 14" until the extension tip member 50 advances through the guide 78 and projects beyond the ferrule 70 and the external shoulder on the leading end of the tubular portion 36' abuts the flange 79 on the guide 78'. The guide 78' is composed of a suitable plastic or other non-conductive insulating material so as to act both as a guide and insulator between the extension tip member 50 and base portion 76. Further, the end of the guide 78' at the end of the bore 77 is visible after the connector body has been assembled as described to designate the color or size of the complete assembly.

It will be appreciated that while the parts to be color-matched have been described as being dyed a particular color in their entirety, it is sufficient to dye only a portion of the part which, for example, would be visible from either end of the connector body. Also, different colors may be applied by coating, color strips, or otherwise applying to a portion of the external surface of the part. Although the embodiments of invention have been described specifically in relation to RCA connectors, the various features described are readily conformable for use in other mini-coax as well as standard cable connectors, such as, for example F-connectors and BNC connectors. It is therefore to be understood that while preferred forms of invention are herein set forth and described, the above and other modifications may be made therein without departing from the spirit and scope of the invention as defined by the appended claims and reasonable equivalents thereof.

I claim:

1. In a cable connector having a hollow cylindrical connector body provided with a fastening member at one end for connection to an electrical device and having a first sleeve in an opposite end of said connector body into which an electrical cable having a pin or wire conductor extending from one end is insertable for connection to said device and wherein said connector body is conformable for connection of different sized cables therein, the improvement comprising:

a centering guide having an external appearance signifying the size of said cable to be inserted, said centering guide being mounted in a bore in said connector body prior to insertion of said cable into said connector body with said conductor extending through said bore and said centering guide.

2. In a cable connector according to claim 1 wherein said centering guide is in the form of a sleeve having a flange at one end thereof.

3. In a cable connector according to claim 1 wherein said centering guide is at least partially visible from one end of said connector body to signify the cable size being inserted into said connector body.

4. In a cable connector according to claim 1 wherein said connector body includes crimping means mounted at said opposite end for crimping said cable to said sleeve in said connector body with a leading end of said cable extending through said bore and said guide.

5. In a cable connector according to claim 4 wherein said crimping means includes a portion having an external appearance signifying the size of said cable to be inserted into said connector body.

6. In a cable connector according to claim 5 wherein a portion of said crimping means and said guide are color-coded to correspond to the cable size to be inserted into said connector body.

7. In a cable connector according to claim 6 wherein said crimping means is in the form of a ring having an inner plastic body.

8. In a coaxial cable connector having a hollow cylindrical connector body provided with a fastening member at one end for connection to an electronic device and having a sleeve in an opposite end into which said coaxial cable is insertable for connection to a selected of said devices, the improvement comprising:

said connector body including a crimping member of a selected size, said crimping member including a portion of a selected color signifying the cable size to be connected to said connector body, said crimping member being mounted on said sleeve prior to insertion of said cable therein; and a centering guide of a selected size disposed in an internal bore of said connector body, said guide being of a color signifying a cable size which is connectable to said connector body.

9. In a coaxial cable connector according to claim 8 wherein said cable has a portion of a selected color signifying a particular cable size and corresponding with the color of said crimping member and said guide.

10. In a coaxial cable connector according to claim 9 wherein said crimping member is interchangeably connectable to said opposite end of said connector body prior to insertion of said cable therein.

11. In a coaxial cable connector according to claim 10 wherein said guide is interchangeably connectable to said connector body prior to insertion of said cable into said opposite end, and wherein said cable includes a pin conductor extending through said guide.

12. In a coaxial cable connector according to claim 11 wherein said cable includes an adapter movable into abutting relation to said centering guide when said pin conductor extends through said guide for electrical connection to a selected device.

13. In a cable connector having a hollow cylindrical body provided with a fastening member in one end for connection to an electrical device and having a first sleeve at an opposite end of said connector into which an electrical cable is insertable for connection to a selected of said devices and wherein said connector body includes crimping means and said body is conformable for connection of different sized cables therein, the improvement comprising:

a centering guide mounted at one end of a bore internally of said body having an external appearance signifying the size of said cable to be inserted, said centering guide being mounted in said connector body prior to insertion of said cable into said connector body wherein said cable includes an adapter movable into abutting relation to said centering guide and wherein a portion of said crimping means and said guide are color-coded to correspond to the cable size to be inserted into said connector body.

14. In a coaxial cable connector according to claim 13 wherein said centering guide is at least partially visible from one end of said connector body to signify the cable size being inserted into said connector body.

* * * * *

UNITED STATES PATENT AND TRADEMARK OFFICE

CERTIFICATE OF CORRECTION

PATENT NO. : 7,241,164 B2
APPLICATION NO. : 10/899787
DATED : July 10, 2007
INVENTOR(S) : Randall A. Holliday It is certified that error appears in the above-identified patent and that said Letters Patent is hereby corrected as shown below:

Column 4, line 60: Please delete "shoulder 82" and replace therefor -- shoulder 83 --.

Column 4, line 65: Please delete "82" and replace therefor -- 83 --.

Signed and Sealed this

Eleventh Day of September, 2007

JON W. DUDAS
*Director of the United States Patent and Trademark Office*